United States Patent [19]

Trendler

[11] Patent Number: 4,549,670

[45] Date of Patent: Oct. 29, 1985

[54] HINGED TISSUE CASSETTE APPARATUS

[75] Inventor: David Trendler, Libertyville, Ill.

[73] Assignee: MacLean-Fogg Company, Mundelein, Ill.

[21] Appl. No.: 683,559

[22] Filed: Dec. 19, 1984

[51] Int. Cl.[4] ..... B65D 43/14; B65D 51/04

[52] U.S. Cl. ..... 220/338; 220/307

[58] Field of Search ..... 220/229, 306, 307, 337, 220/338; 425/84, 85, 117

[56] References Cited

U.S. PATENT DOCUMENTS

| | | | |
|---|---|---|---|
| Re. 28,165 | 9/1974 | McCormick | 220/229 |
| 2,732,581 | 1/1956 | Heck | 220/338 |
| 4,220,252 | 9/1980 | Beall et al. | 220/307 |

*Primary Examiner*—George T. Hall

*Attorney, Agent, or Firm*—Mason, Kolehmainen, Rathburn & Wyss

[57] ABSTRACT

Tissue cassette apparatus includes a removable, hinged cover separate from the cassette base wherein the cover is easily attachable and detachable from the base without being frangible. The removable cover includes a hinge member portion mateable with a cooperable hinge member portion on the cassette base structurally formed so that the hinge member portions cannot be separated when the cover member is closed on the base, but easily can be separated when the cover member is in a predetermined, opened position. The cover member is rotatable about the hinge member to an open position permitting placement of a specimen within the cassette base and to a closed position containing a specimen within the cassette base such that the cover member can be removed from the cassette base by elastic flexing of the hinge member without substantial damage to the hinge member.

18 Claims, 8 Drawing Figures

Fig-4
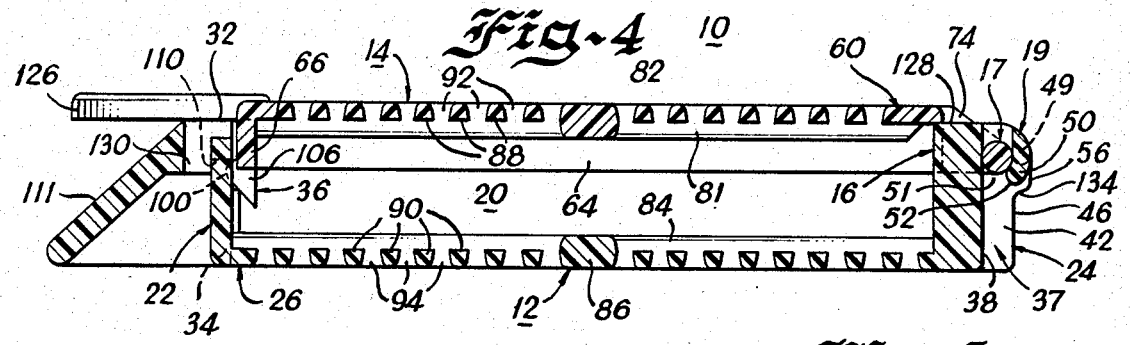
Fig-5
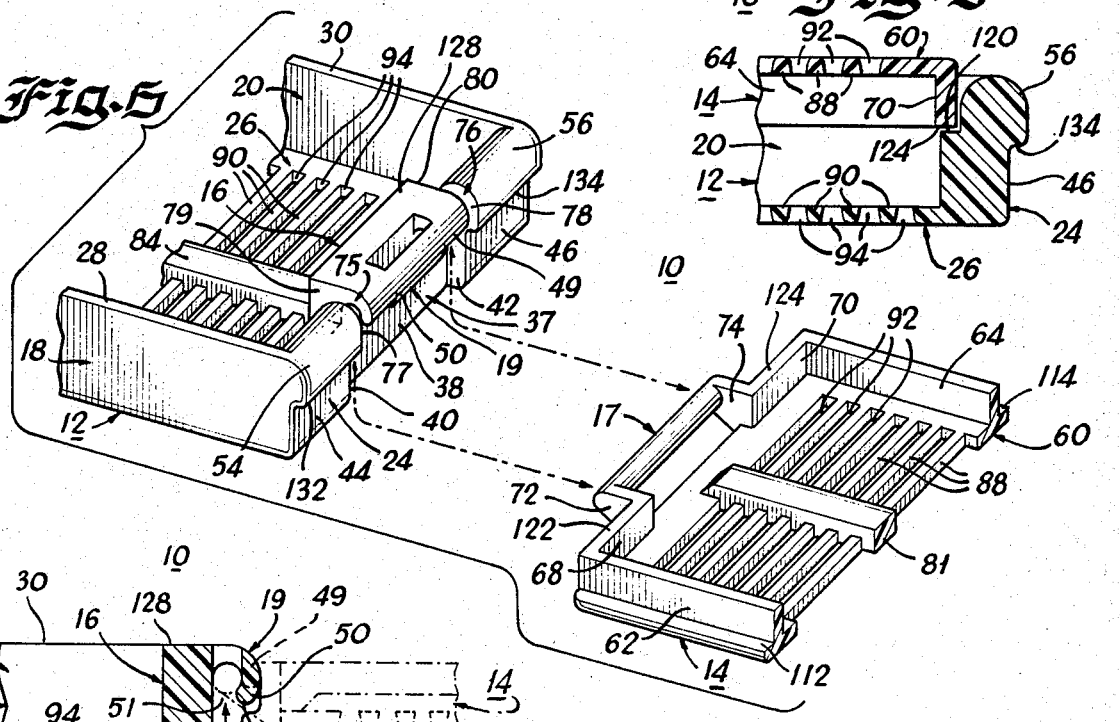
Fig-6
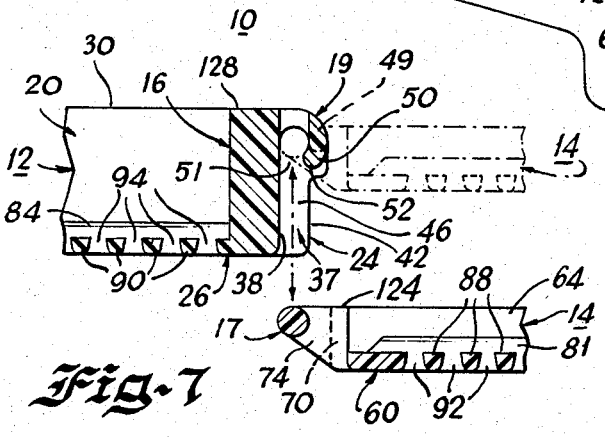
Fig-7
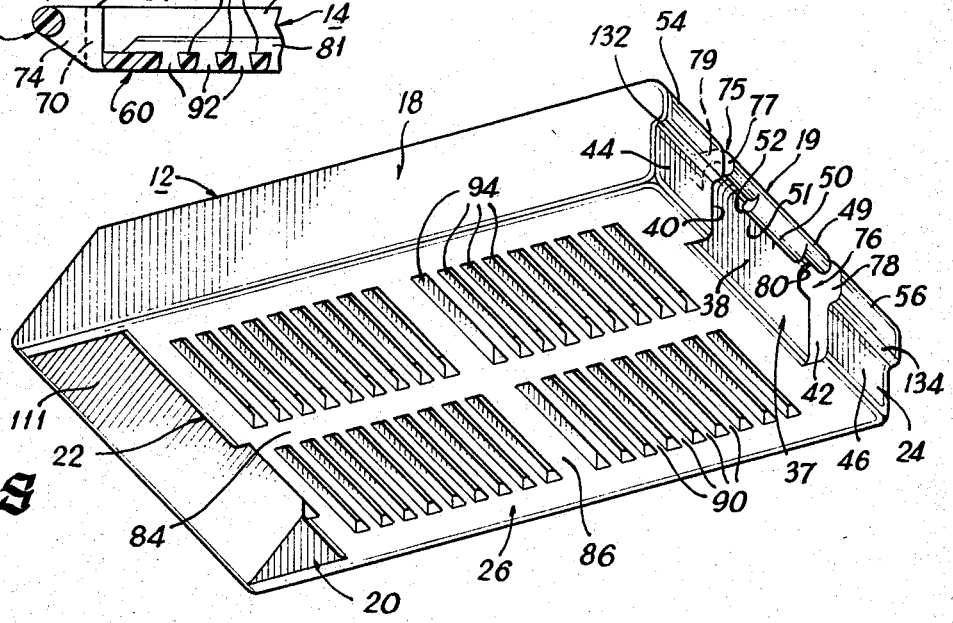
Fig-8

HINGED TISSUE CASSETTE APPARATUS

A. FIELD OF THE INVENTION

The present invention is directed to tissue cassette apparatus for containing a tissue specimen during contact of the tissue specimen with a processing liquid including a liquid-penetrable tissue specimen receiving cassette base and a removable cassette cover member to lock the tissue specimen in place to prevent inadvertent removal of the tissue specimen during liquid processing.

B. BACKGROUND OF THE INVENTION AND PIOR ART

As well known in the art, biological tissue specimens are processed with liquids to dehydrate the tissue and the specimen may be subjected to other preparatory liquid treatment steps while the specimen is contained within one of many forms of a receptacle called a tissue cassette. After liquid processing, the biological tissue is ready for slicing into thin sections on a microtome for microscopic examination by a pathologist.

One common and inexpensive form of the tissue cassette used for liquid-processing of a biological tissue specimen is a liquid-permeable receptacle made from a suitable plastic, such as acetal, polyethylene, or polypropylene, and includes a cover member initially attached to the receptacle via a frangible hinge. The cover member is attached via the frangible hinge so that after liquid processing of the tissue specimen within the receptacle, the frangible hinge can be broken to remove the cover member. The cover member must be removed for attachment of the dehydrated tissue sample to the base of the tissue cassette so that the base, with attached tissue specimen, can be secured to a microtome for slicing of the tissue specimen. A typical example of such tissue cassettes having frangible hinged covers is described in U.S. Pat. No. 4,220,252. As set forth in U.S. Pat. No. 4,220,252, one of the problems associated with tissue cassettes including a cover member attached via a frangible hinge is that if the hinge portion becomes broken before the processing steps are finished, the cover member does not remain mated against the base member resulting in loss of specimens. The frangible hinges sometimes are easily broken off and sometimes very difficult to remove because small differences in frangible hinge thicknesses cause dramatic differences in needed cover removal forces.

One attempt to eliminate this problem is disclosed in U.S. Pat. No. 4,220,252 describing a tissue cassette having a cooperable detent and abutment means or latch mechanism adjacent the frangible hinge and a cooperable detent and abutment means on an opposite wall member of the tissue cassette. In accordance with U.S. Pat. No. 4,220,252, if the frangible hinge breaks prematurely, the latch mechanism adjacent the frangible hinge theoretically will maintain the cover member in place. Many times, the frangible hinge breaks before the cover member is closed so that the cover member and pair of latches must be manually and visually aligned with the base. Further, the safety latch adjacent to the frangible hinge, in this type of apparatus provides a relatively substantial degree of resistance to cover closing.

Another type of tissue cassette having a separate cover member is described in U.S. Pat. No. Re. 28,165, a reissue of U.S. Pat. No. 3,674,936. In accordance with No. Re. 28,165, a reusable stainless steel cover is attachable to a disposable cassette base by spring clips disposed at opposite ends of the cover member. Problems associated with this type of tissue cassette include the inconvenience of properly aligning the cover member with the base to contain a biological specimen for liquid processing and in maintaining a tight cover fit after repeated cover use. The users also find it much more convenient for a cover member to be initially attached to each base.

SUMMARY OF THE INVENTION

In brief, the present invention is directed to a tissue cassette including a removable, hinged cover separate from the cassette base wherein the cover is easily attachable and detachable from the base without being frangible. The removable cover includes a hinge member portion mateable with a cooperable hinge member portion on the cassette base structurally formed so that the hinge member portion cannot be separated when the cover member is closed on the base, but easily can be separated when the cover member is in a predetermined, opened position.

Accordingly, an object of the present invention is to provide a tissue cassette including a cassette base and a cassette cover hingedly attachable and detachable through a flexible, elastic hinge member.

Another object of the present invention is to provide a tissue cassette having a hinged cover member attachable to and detachable from a cassette base without damage to the hinge member.

A further object of the present invention is to provide a tissue cassette having a hinged cover member attachable to and detachable from a cassette base such that the cover member is rotatable about the hinge member to an open position permitting placement of a specimen within the cassette base and to a closed position containing a specimen within the cassette base such that the cover member can be removed from the cassette base by elastic flexing of the hinge member without substantial damage to the hinge member.

Still another object of the present invention is to provide a tissue cassette including a cassette base and a cassette cover wherein the cassette cover is attachable to and detachable from the cassette base through a cassette base hinge portion and a cassette cover hinge portion and wherein the cassette base is a disposable item capable of use with existing reusable cover members, such as the cover member disclosed in No. Re. 28,165, which patent is hereby incorporated by reference.

Another object of the present invention is to provide tissue cassette apparatus having markedly improved consistency in force required for cover closing and cover removal and having a detachable cover member easily removed and attached but very difficult to separate from the cassette base inadvertently.

BRIEF DESCRIPTION OF THE DRAWINGS

The above and other objects and advantages of the present invention will become apparent from the following detailed description of the preferred embodiment taken in conjunction with the drawings wherein:

FIG. 4 is an enlarged, cross-sectional view of the tissue cassette apparatus of the present invention taken through the line 4—4 of FIG. 3;

FIG. 5 is a partially broken-away cross-sectional view of the tissue cassette apparatus of the present invention taken through the line 5—5 of FIG. 3;

FIG. 6 is a partially broken-away perspective view of the tissue cassette apparatus of the present invention showing the cassette cover member detached from the cassette base;

FIG. 7 is a partially broken away cross-sectional view of the tissue cassette apparatus of the present invention showing the cassette cover member hingedly attached in broken lines and detached in solid lines;

FIG. 8 is a bottom, enlarged perspective view of the cassette base portion of the apparatus of the present invention.

DETAILED DESCRIPTION OF THE PREFERRED EMBODIMENT

Figure 1:
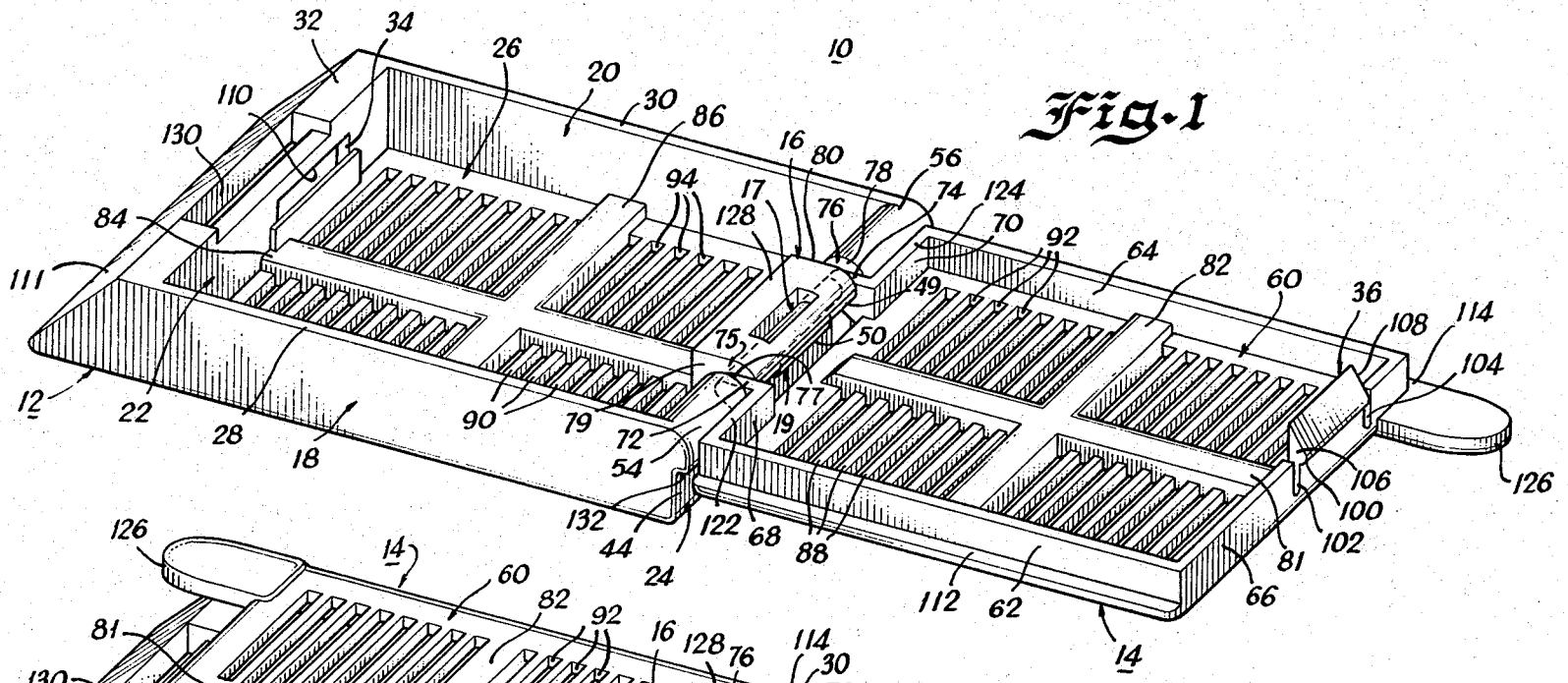
FIG. 1 is an enlarged perspective view of the tissue cassette apparatus of the present invention showing a cassette cover member in an open position hingedly attached to a cassette base.
Figure 3:
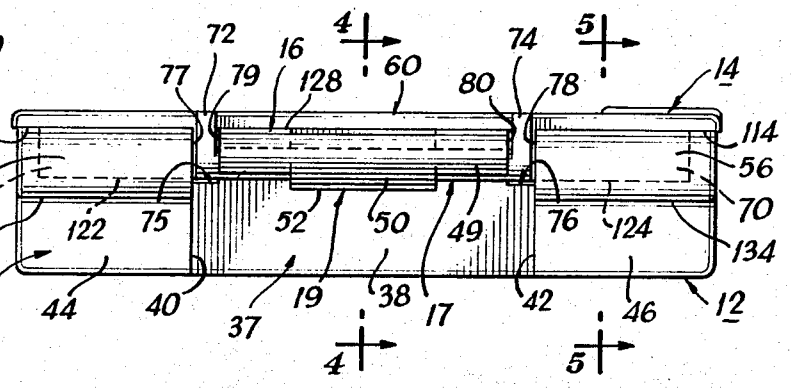
FIG. 3 is a rear elevational view of the tissue cassette apparatus of the present invention with the cover member in a closed position.
Figure 2:
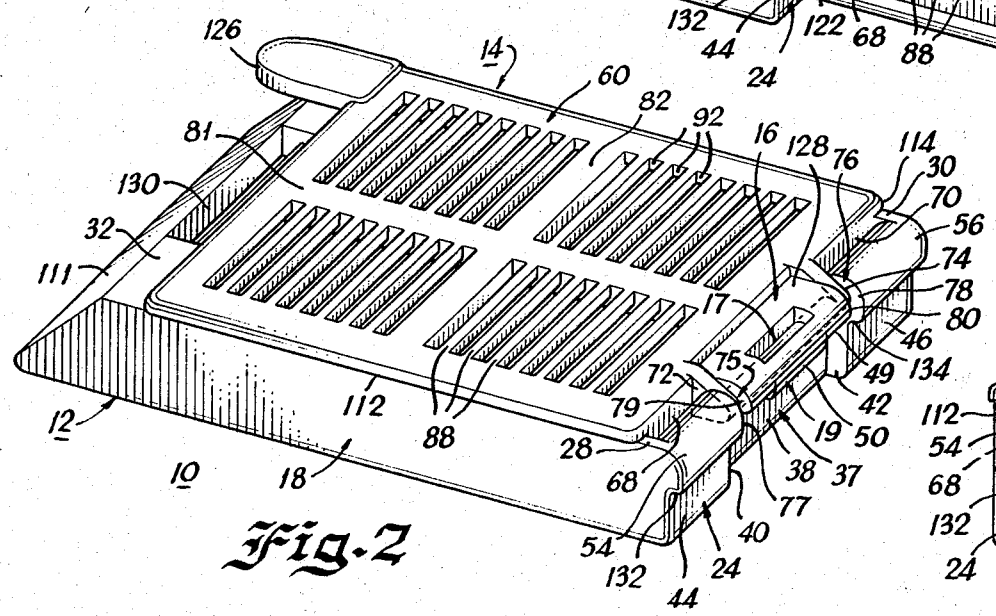
FIG. 2 is an enlarged perspective view of the tissue cassette apparatus of the present invention showing the cover member in a closed position.

Turning now to the drawings, and initially to FIGS. 1 and 2, there is illustrated a tissue cassette, generally designated by reference numeral 10, including a tissue cassette base, generally designated 12, and a tissue cassette cover, generally designated 14. The cassette cover 14 is attachable and detachable from the cassette base 12 by a cassette base hinge member generally designated 16, including an elongated hinge pin-receiving hook portion, generally designated 19, and a cassette cover hinge pin member 17.

The cassette base 12 includes two longitudinal side walls 18 and 20, spaced from and essentially parallel to each other connected to each other at their ends by a front, transverse end wall, generally designated 22, and a rear transverse end wall, generally designated 24. The longitudinal and transverse base walls 18, 20, 22, and 24 extend upwardly from a liquid-penetrable lower wall, generally designated 26, of the tissue cassette base 12. The two longitudinal side walls 18 and 20 and the front transverse end wall 22 terminate at planar wall edges 28, 30, and 32, respectively, lying in a common plane. These upper wall edges 28, 30 and 32 support the cover member 14 when the cover member is in a closed position, as will be described in more detail hereinafter. The front transverse end wall 22 of the base 12 includes an elongated slot 34 spaced from the upper edge 32 of the front transverse end wall 22 disposed to receive a cooperable latch member, generally designated 36, in the cover member 14.

In accordance with an important feature of the present invention, the rear transverse end wall 24 of the cassette base 12 is formed to include the cassette base hinge member portion 16 cooperable with the hinge pin member 17 of the cover member 14 so that the cover member 14 is attachable to and detachable from the cassette base 12 and rotatable about the base 12 to open and closed positions, as shown in FIGS. 1 and 2.

As best shown in FIGS. 6 and 8, the rear transverse end wall 24 of the cassette base 12 includes a generally U-shaped central portion, generally designated 37, including a transverse wall portion 38 and two integral, perpendicular longitudinal wall portions 40 and 42 forming legs of the U-shaped central portion. The central wall portion 38 supports the cassette base hinge member 16 at a location inwardly spaced from the remainder of the transverse end wall 24 so that the hinge pin-receiving hook portion 19 of the base hinge member 16 can extend rearwardly to dispose the hinge pin-receiving hook portion 19 of hinge member 16 in longitudinal alignment with the remainder of the transverse wall 24, as will be described in more detail hereinafter.

The leg walls 40 and 42 of the generally U-shaped central portion 37 of the transverse rear end wall 24 communicate with the longitudinal side walls 18 and 20, respectively, of the tissue cassette base 12 through transverse end wall portions 44 and 46, respectively. Other constructions are possible to longitudinally align the hinge pin-receiving hook portion of the base hinge member 16 with the base transverse end wall portions 44 and 46, but the alignment of the hinge pin 17 with the base transverse end wall portions 44 and 46 is important, in one embodiment, to prevent inadvertent cover removal, as will become more apparent hereinafter.

As best shown in FIGS. 4 and 7, the hinge pin receiving hook portion 19 of the base hinge member 16 extends rearwardly from an upper portion of the spaced, central wall portion 38 of the transverse end wall 24. As best shown in FIGS. 7 and 8, the hinge pin-receiving hook portion 19 of the base hinge member 16 is generally C-shaped including an elongated relatively rigid portion 49 and a shorter, centrally disposed elastically flexible extension member 50. The elastically deformable C-shaped hook member extension portion 50 curves inwardly toward wall portion 38 to define a pin receiving opening 51 having a dimension 5–25% smaller than the diameter of the hinge pin member 17 of the cover 14. The extension portion 50 extending from the C-shaped pin-receiving hook portion 19 of the cassette base hinge member 16 includes a rounded end 52 at the pin-receiving opening 51 so that with the cover removed, as shown in FIG. 7, the hinge pin member 17 of cover 14 can be forced upwardly against the rounded end 52 of the C-shaped hook member extension portion 50 to elastically deform the C-shaped hook member portion 50 rearwardly to expand the pin-receiving opening 51 so that the hinge pin member 17 can be manually forced into the position shown in dashed lines in FIG. 7. After attachment, the elastically deformable C-shaped hook member extension portion 50 will elastically return to its position shown in FIG. 7 to maintain the cover member 14 hingedly attached to the cassette base 12 until after liquid processing of the biological specimen. After liquid processing, the cover member 14 can be manually removed by forcing the hinge pin member 17 of the cover 14 downwardly to enlarge the pin-receiving opening 51 by elastic deformation of the C-shaped hook member extension portion 50 for removal of the hinge pin member 17 from the cassette base hinge member 16 and thereby remove the cover 14.

In accordance with another important feature of the present invention, the cassette base 12 includes a pair of cover member stop walls 54 and 56 forming upper surfaces of the transverse end wall portions 44 and 46 each having a cylindrically shaped upper surface. These stop walls 54 and 56 prevent the cover member 14 from being detached inadvertently from the cassette base 12 since they will prevent cover removal unless the cover member 14 is in a substantially completely open position as shown in FIG. 1. It is understood that the structural configuration of the rear transverse end walls 44 and 46 of the cassette base 12 and cover member 14 can be altered to permit cover removal at other predetermined rotational dispositions of cover member 14 to cassette base 12. The function of the cover member stop walls 54 and 56 will become more apparent with reference to the following description of the structural features of the cover member 14.

The cover member 14 includes a liquid-penetrable upper wall 60; integral, downwardly (in closed position) extending longitudinal side walls 62 and 64; an integral front transverse end wall 66; a pair of rear transverse end wall leg segments 68 and 70 each having a longitudinally extending, integral foot segment 72 and 74, respectively, supporting the hinge pin member 17 of the cover member 14 integrally therebetween. The hinge pin member 17 extends transversely between the foot segments 72 and 74 of the rear transverse end wall leg segments 68 and 70, as best shown in FIG. 6. The foot segments 72 and 74 fit into slots 75 and 76 in the transverse end wall 24 when the cover member is closed. The slots 75 and 76 are defined by innermost edges 77 and 78 of the cylindrically shaped upper surfaces 54 and 56 of transverse end wall portions 44 and 46 of the base 12, and the outermost edges 79 and 80 of the base hinge member 16.

In accordance with an important feature of the present invention, the rear transverse end wall leg segments 68 and 70 cooperate with the cover member stop walls 54 and 56 of the cassette base 12 to prevent the cover member 14 from being removed inadvertently from the cassette base 12 unless the cover member 14 is in a substantially completely open position, as shown in FIG. 1.

As shown in FIG. 1, with the cover member 14 hingedly attached to the cassette base 12, the hinge pin member 17 of cover member 14 is in longitudinal alignment with a central axis of the cylindrically shaped cover member stop walls 54 and 56 of the cassette base 12. The leg segments 68 and 70 of the cover member 14 are longitudinally spaced from the hinge pin member 17 by the integral longitudinally extending foot segments 72 and 74. Accordingly, cover member transverse end wall leg segments 68 and 70 are maintained closely adjacent to the cylindrically shaped upper surfaces of the cover member stop walls 54 and 56 during the entire rotational movement of the cover member 14 with respect to the cassette base 12 during opening and closing of the cover member 14. This construction prevents inadvertent removal of the cover member 14 from the base 12 until the cover member 14 is in a substantially completely open position, as shown in FIG. 1.

Because of the close tolerance between the cover member transverse wall leg segments 68 and 70 with respect to the cover member stop walls 54 and 56 of the base 12, during the entire rotational movement of the cover member 14, a downward force applied to the cover member 14, which would separate the hinge pin member 17 of the cover member 14 from the hinge member 16 of the base 12 if the cover member were in a substantially completely open position, will not cause hinge member portions 16 and 17 to separate if the cover member 14 is not substantially completely open. If not substantially completely open, a downward force on the cover member 14 will cause the transverse end wall leg segments 68 and 70 of cover member 14 to contact the cover member stop walls 54 and 56 of the base 12 so that the hinge pin member 17 of the cover member 14 cannot be released from the elastically deformable C-shaped hook member extension 50 of the base hinge member 16. Accordingly, it is almost impossible to find inadvertent separation of the cover member 14 from the base 12 so that biological specimens mens will not be lost when using the apparatus of the present invention.

In accordance with another important feature of the present invention, the liquid-penetrable upper wall 60 of the cover member 14, and the liquid-penetrable lower wall 26 of the base 12 are formed to achieve maximum strength consistent with maximum liquid flow through. As shown in FIG. 1, cover member 14 includes a centrally disposed longitudinal strength rib 81 and a transverse, centrally disposed strength rib 82 formed integrally with each other and integral with the cover member 14. Similarly, the cassette base 12 includes a centrally disposed longitudinal strength rib 84 and a transverse, centrally disposed strength rib 86 formed integrally with each other and with the cassette base 12. The strength ribs 81 and 82 of the cover member 14 and the strength ribs 84 and 86 of the cassette base 12 define four liquid penetrable rectangular quadrants in both the cover member 14 and the cassette base 12, as shown in FIG. 1.

A plurality of longitudinally separated smaller ribs 88 are formed parallel to the transverse strength rib 82 and perpendicular to the longitudinal strength rib 81 in the cover member 14, and a plurality of longitudinally separated smaller ribs 90 are formed parallel to the transverse strength rib 86 and perpendicular to the longitudinal strength rib 84 in the cassette base 12 to define a plurality of liquid-penetrable, elongated rectangular apertures 92 and 94 in the cover member 14 and in the cassette base 12, respectively, between the ribs 88 and 90, respectively.

In accordance with a new and unexpected feature of the present invention, the strength and flow-through properties attributable to the liquid-penetrable wall construction above described provides new and unexpected strength to the cover member 14 and cassette base 12 while providing unexpectedly fast flow-through of liquids so that biological specimens can be processed in a minimum amount of time. While the strength of the cover member 14 is not particularly significant, the strength of the cassette base 12 is important so that when the base 12 is inserted in a specimen holder for attachment of a cassette base 12 to a microtome, the longitudinal side walls 18 and 20 are not compressed significantly so that specimens encased in wax are not separated from the cassette base 12 and so that the cassette base 12 does not separate from a microtome cassette base clamp.

As shown in FIGS. 1 and 2, the latch 36 of cover member 14 is tapered and includes a forward ledge wall 100 adapted to lock the cover member 14 onto the base 12 at the front transverse end wall 22. The front transverse end wall 66 of cover member 14 includes two elongated slots 102 and 104 one adjacent each side wall 106 and 108 of the latch 36 to make the latch 36 more flexible so that the latch 36 can flex easily rearwardly to close and lock the cover member 14 into the slot 34 of the base front transverse wall 22 when the ledge 100 snaps under an upper edge 110 of the slot 34 in cassette base front transverse end wall slot 34. The cassette base 12 includes a front slanted wall 111 extending outwardly and downwardly from the transverse end wall 22. The cover member 14 includes longitudinal flanges 112 and 114 integral with and extending perpendicular to the cover member longitudinal side walls 62 and 64 for contact against the planar upper surfaces of the cassette base longitudinal side walls 18 and 20 when the cover member is in a closed position. The longitudinal side walls 62 and 64 of the cover member 14 fit within the cassette base 12 closely adjacent to the longitudinal side walls 18 and 20 of the base 12, when the cover member 14 is in a closed position.

In accordance with another important feature of the present invention, as best shown in FIGS. 5 and 6, the rear transverse end wall portions 44 and 46 of the cassette base 12 each include an interior stop ledge 120 disposed in close vertical alignment with lowermost edges 122 and 124 of the cover member rear transverse end wall leg segments 68 and 70 when the cover member 14 is in a closed position. The ledges 120 prevent the cover member hinge pin 17 from being separated from the base hinge pin-receiving hook portion 19 when the cover member is closed, if a downward force is applied to the cover member at the hinge pin 17. The lowermost edges 122 and 124 of the cover member transverse end wall leg segments 68 and 70 will contact the ledges 120 to prevent further downward relative movement of the cover member 14 with respect to the cassette base 12 before the hinge pin member 17 separates from the hinge pin receiving hook portion 19.

As shown in FIGS. 1 and 2, the cover member 14 includes an elongated opening tab 126 integral with the cover member 14 and extending beyond the upper edge 32 of the front transverse end wall 22 of the cassette base 12. As shown in FIG. 2, the tab 126 can be manually grasped to lift the cover member 14 from cassette base member 12 to open the cover member 14. The upper surface 32 of the cassette base transverse end wall 22 is in contact with the elongated opening tab 126 when the cover member is closed to provide further support for the cover member 14. Also, the cassette base hinge member 16 includes a flat upper surface 128 lying in a common plane with an undersurface of the ribs 88 of the cover member 14 when the cover is in a closed position so that the flat upper surface 128 of base hinge member 16 acts as a further stop wall to prevent separation of cover member 14 from the cassette base 12 when the cover member 14 is in a closed position.

In accordance with another important feature of the present invention, the cassette base 12 includes a slot 130 in the upper surface 32 of front transverse end wall 22 to accept a tongue or spring latch of a reusable cover, such as that disclosed in U.S. Pat. No. Re. 28,165. The cylindrically shaped stop walls 54 and 56 of the rear transverse end wall portions 44 and 46 of the base 12 are shaped to include flat ledges 132 and 134 below the cylindrically shaped stop walls 54 and 56 to accept two rear spring latches on a reusable cover member, such as that shown in No. Re. 28,165. Accordingly, the cassette base 12 can accept a completely different, non-hinged reusable cover, as well as the cover member 14 disclosed herein. A reusable cover disclosed in No. Re. 28,165, and useful herein is formed of a perforated rectangular flat plate with a tongue portion extending downwardly and outwardly from the mid portion of one transverse edge of the plate, includes a tab extending from the mid portion of the opposing transverse edge of the plate coplanar with the plate, and has a spring latch member located at the side of the tab extending downwardly from the transverse edge of the plate. The cover of No. Re. 28,165 is capable of being removably attached to the tissue cassette base 12 with the tongue portion of the cover inserted through the transverse slot 130 in the cassette base 12 and the spring latch member of the cover placed over the cylindrically shaped transverse stop wall portions 54 and 56 of the base 12. The cassette 10 provides a fluid-permeable capsule in which a biological specimen can be treated with a selected fluid, the lower wall 26 of the tissue cassette base 12 and the removable cover both having a plurality of perforations the cross-sectional dimensions of which are smaller than any dimensions of a specimen to be processed in the cassette 10.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. Apparatus for containing a tissue specimen during contact of said tissue specimen with a processing liquid comprising;

a liquid-penetrable receptacle having one or more wall members defining an open area adapted to receive a tissue specimen and adapted to support a liquid-penetrable cover member;

a separate liquid-penetrable cover member adapted to be supported on said receptacle to cover said open area in a closed position to prevent said tissue specimen from inadvertent removal from said receptacle with the cover member disposed to cover said open area;

said cover member being attachable to and detachable from said receptacle through a flexible, elastic hinge member such that when the cover member is attached to the receptacle at the hinge member, the cover member is rotatable about said hinge member to an open position permitting placement of a specimen within the receptacle and to a closed position containing a specimen within the receptacle for liquid processing and after liquid processing, the cover member can be removed from the receptacle by elastic flexing of the hinge member without substantial damage to said hinge member.

2. The apparatus of claim 1 wherein said cover member includes one or more detent members interengageable with a first wall member of the receptacle to aid in maintaining the cover member in a closed position during liquid processing.

3. The apparatus of claim 2 wherein the receptacle includes a second wall member disposed opposite said first wall member and wherein said hinge member includes at least one flexible, elastic hinge pin socket member extending from said second wall member, at least a portion of said hinge pin socket member including a resilient wall elastically flexible to removably receive a hinge pin therein and disposed to maintain the hinge pin within the socket member to prevent inadvertent removal of the hinge pin from the socket member.

4. The apparatus of claim 1 wherein the receptacle is rectangularly shaped including a bottom wall; two generally parallel, spaced side walls; and two generally parallel end walls defining the tissue-receiving receptacle; wherein the cover member is shaped to overlie an upper surface of the side walls and the end walls to cover the receptacle; and wherein the hinge member includes an elongated generally C-shaped flexible, elastic socket member integral with and extending from one of the end walls and adapted to receive a cover member hinge pin; and wherein the cover member is substantially rectangularly shaped having two generally parallel longitudinal side walls and front and rear generally parallel transverse end walls and includes an integral hinge pin extending from the rear end wall such that the cover member hinge pin can be forcibly inserted into the receptacle socket member and forcibly removed therefrom by elastic flexing of said socket member.

5. In a tissue cassette apparatus for containing a tissue specimen during contact of the tissue specimen with a processing liquid including a liquid penetrable tissue cassette base forming an open receptacle for a tissue specimen and a separate, liquid-penetrable cassette cover member adapted to cover said cassette base in a closed position to contain said tissue specimen within said cassette base, the improvement comprising:

a first hinge portion formed integrally with the cassette base and a second cooperable hinge member portion formed integrally with the cassette cover member, said first and second hinge member portions cooperably formed for hinged attachment and detachment without substantial damage to said first or second hinge member portions such that when the cassette cover member is hingedly attached to the cassette base at the first and second hinge member portions, the cover member is rotatable at said first and second hinge member portions to an open position permitting placement of a tissue specimen within the tissue cassette base and to a closed position containing a tissue specimen within the cassette base for liquid processing and, after liquid processing, the first and second hinge member portions can be separated easily for removal of the cover member from the cassette base.

6. The apparatus of claim 5 wherein the cassette base includes two longitudinal side walls and front and rear transverse end walls and wherein the cassette cover includes two longitudinal side walls and front and rear transverse end walls, wherein the first hinge member portion is integral with the rear transverse end wall of the cassette base and the second hinge member portion is integral with the rear transverse end wall of the cassette cover, and wherein the rear transverse end wall of the cassette base and the rear transverse end wall of the cassette cover include cooperable stop means for restricting the separation of the cassette cover member from the cassette base to predetermined relative rotational positions of the cassette cover member with respect to the cassette base member.

7. The apparatus of claim 6 wherein the stop means includes a wall member integral with the rear transverse end wall of the cassette base having a cylindrically shaped surface and a wall portion integral with the rear transverse end wall of the cassette cover disposed adjacent to the cylindrically shaped cassette base wall member, when the cassette cover is hingedly connected to the cassette base, such that at predetermined rotational positions of the cassette cover member with respect to the cassette base said cassette cover wall portion overlies the cylindrically shaped cassette base wall portion in close proximity thereto such that force applied to the cassette cover member when at said predetermined rotational positions in an attempt to separate the first and second hinge member portions will cause said cassette cover member wall portion to come in contact with the cylindrically shaped surface before the first and second hinge member portions separate to prevent said separation, except when the cassette cover member is at other predetermined rotational positions with respect to the cassette base.

8. The apparatus of claim 5 wherein one of said hinge member portions includes an elongated, flexible, elastic hinge pin socket and the other of said hinge member portions includes an elongated hinge pin and wherein a hinge pin socket portion is capable of being forcibly, temporarily flexed to expand a pin-receiving socket opening therein and said socket portion is sufficiently elastic to return to its preforced position to contain the hinge pin within the hinge pin socket during liquid processing of the tissue specimen.

9. The apparatus of claim 8 wherein the hinge pin socket is C-shaped and wherein the diameter of the hinge pin is greater than the dimension of the opening of the C-shaped socket such that force applied by the hinge pin against the socket opening will cause the socket opening to temporarily expand and then return to the original socket dimensions upon hinge attachment and detachment.

10. A tissue cassette base having a front end and a rear end and adapted to receive a tissue specimen and a separate cover member during processing of said tissue specimen with a processing liquid comprising:

a liquid-penetrable generally planar lower wall integral with two longitudinal side walls and front and rear transverse end walls;

means operatively associated with the front end of the cassette base for receiving a cover spring latch member for retaining the cover over the side walls and end walls of the cassette base to retain the tissue specimen therein during liquid processing;

the rear transverse end wall of the cassette base including a pair of upstanding spring latch-receiving transverse wall portions in longitudinal alignment with each other, each having a cylindrically shaped upper surface and a generally planar ledge wall disposed under the cylindrically shaped upper surface; the rear transverse end wall further including a centrally disposed transverse wall portion disposed between the spring latch receiving wall portions having a generally planar upper surface lying generally in the same plane as the uppermost portions of the cylindrically shaped upper surfaces of the pair of spring latch receiving transverse wall portions, said ledge walls adapted to receive a pair of cover member spring latches to retain the tissue specimen within the cassette base during liquid processing.

11. The tissue cassette base of claim 10 wherein said centrally disposed transverse wall portion is longitudinally spaced from the pair of spring latch receiving wall portions and wherein the centrally disposed transverse wall portion includes a rearwardly extending hinge pin-receiving socket member including an elastic flexible socket adapted to receive and removably retain a cover member hinge pin.

12. The tissue cassette base of claim 11 wherein the centrally disposed transverse wall portion extends rearwardly sufficiently to longitudinally align the hinge pin-receiving socket member with longitudinal axes of the cylindrically shaped spring latch receiving transverse wall portions.

13. The tissue cassette base of claim 12 wherein the hinge pin-receiving socket member is a generally C-shaped flexible elastic socket integral with the rearwardly extending, centrally disposed transverse end wall portion.

14. The tissue cassette base of claim 10 further including a spring latch receiving slot defined by surrounding interior wall portions of the front transverse end wall.

15. The tissue cassette base of claim 10 wherein the liquid-penetrable lower wall includes a pair of intersecting, generally perpendicular strength ribs, one extending between the longitudinal side walls and the other extending between the front and rear transverse end walls to divide the lower wall into four, generally equal liquid-penetrable segments.

16. Apparatus for containing a tissue specimen during contact of said tissue specimen with a processing liquid comprising:

(i) a tissue cassette base having a front end and a rear end and adapted to receive a tissue specimen and a separate cover member during processing of said tissue specimen with a processing liquid, said base including a liquid-penetrable generally planar lower wall integral with two longitudinal side walls and front and rear transverse end walls;

means operatively associated with the front end of the cassette base for receiving a cover tongue member;

the rear transverse end wall of the cassette base including an upstanding spring latch-receiving transverse wall portion having a cylindrically shaped upper surface and a generally planar ledge wall disposed under the cylindrically shaped upper surface; the rear transverse end wall further including a centrally disposed transverse wall portion disposed between the spring latch-receiving wall portions having a generally planar upper surface lying generally in the same plane as the uppermost portions of the cylindrically shaped upper surfaces of the pair of spring latch receiving transverse wall portions, said ledge walls adapted to receive a pair of cover member spring latches to retain the tissue specimen within the cassette base during liquid processing; and (ii) a removable separate cover member including a liquid-penetrable generally planar major wall having a tongue portion extending downwardly from a front edge thereof and a cover spring latch member extending downwardly from a rear edge thereof, said tongue portion adapted to be received by said cassette base and said latch member adapted to be received by the latch-receiving wall portions of said cassette base.

17. Apparatus for containing a tissue specimen during contact of said tissue specimen with a processing liquid comprising:

(i) a tissue cassette base having a front end and a rear end and adapted to receive a tissue specimen and a separate cover member during processing of said tissue specimen with a processing liquid, said base including a liquid-penetrable generally planar lower wall integral with two longitudinal side walls and front and rear transverse end walls;

means operatively associated with the front end of the cassette base for receiving a cover tongue member;

the rear transverse end wall of the cassette base including an upstanding spring latch-receiving transverse wall portion each having a cylindrically shaped upper surface and a generally planar ledge wall disposed under the cylindrically shaped upper surface; the rear transverse end wall further including a centrally disposed transverse wall portion disposed between the spring latch receiving wall portions having a generally planar upper surface lying generally in the same plane as the uppermost portions of the cylindrically shaped upper surfaces of the pair of spring latch receiving transverse wall portions, said ledge walls adapted to receive a pair of cover member spring latches to retain the tissue specimen within the cassette base during liquid processing; and (ii) a removable cover for said tissue cassette base, said removable cover formed of a perforated rectangular flat plate with a tongue portion extending downwardly and outwardly from the mid portion of one transverse edge of said plate, a tab extending from the mid portion of the opposing transverse edge of said plate coplanar with said plate, and a spring latch member located at the side of said tab and extending downwardly from said transverse edge of said plate, said cover capable of being removably attached to said tissue cassette base with the tongue portion of said cover inserted through a transverse slot in said cassette base and the spring latch member of said cover placed over the cylindrically shaped transverse wall portions of the base, said apparatus providing a fluid-permeable capsule in which a biological specimen can be treated with selected fluid, said lower wall of the cassette base and said removable cover both having a plurality of perforations the cross-sectional dimensions of which are smaller than any corresponding dimensions of a specimen to be processed in said apparatus.

18. The apparatus of claim 17 wherein the rear transverse end wall of the cassette base includes a pair of upstanding spring latch-receiving transverse wall portions in longitudinal alignment with each other and wherein the cover member includes a pair of spring latches adapted to be received under said ledge walls.

* * * * *